United States Patent [19]

Esper

[11] 4,405,150

[45] Sep. 20, 1983

[54] COLLAPSIBLE SKIS

[76] Inventor: Herbert Esper, Bad Abbach, Fed. Rep. of Germany

[21] Appl. No.: 233,998

[22] Filed: Feb. 12, 1981

[30] Foreign Application Priority Data

Jun. 19, 1980 [EP] European Pat. Off. ..... 80103411.7
Jun. 23, 1980 [EP] European Pat. Off. ..... 80103037.0

[51] Int. Cl.[3] ..... A63C 5/02
[52] U.S. Cl. ..... 280/603
[58] Field of Search ..... 280/603

[56] References Cited

U.S. PATENT DOCUMENTS

| | | | |
|---|---|---|---|
| 2,450,538 | 10/1948 | Beaudin | 280/603 |
| 3,596,918 | 8/1971 | Masuda | 280/603 |
| 3,689,093 | 9/1972 | Meland . | |
| 3,797,838 | 3/1974 | Shurgot et al. | 280/603 |
| 3,825,360 | 7/1974 | Galich | 280/603 |
| 4,125,273 | 11/1978 | Rothmayer | 280/603 |
| 4,262,924 | 4/1981 | Corwin | 280/603 |

FOREIGN PATENT DOCUMENTS

| | | | |
|---|---|---|---|
| 112668 | 11/1928 | Austria . | |
| 291062 | 6/1971 | Austria . | |
| 342473 | 4/1978 | Austria . | |
| 363016 | 7/1981 | Austria . | |
| 1913606 | 7/1970 | Fed. Rep. of Germany . | |
| 2014647 | 10/1971 | Fed. Rep. of Germany . | |
| 2452728 | 5/1976 | Fed. Rep. of Germany . | |
| 2756148 | 6/1978 | Fed. Rep. of Germany . | |
| 898906 | 5/1945 | France . | |
| 107557 | 6/1943 | Sweden | 280/603 |
| 164569 | 10/1933 | Switzerland . | |
| 167538 | 2/1934 | Switzerland . | |
| 171068 | 8/1934 | Switzerland . | |

*Primary Examiner*—David M. Mitchell
*Assistant Examiner*—Kenneth R. Rice
*Attorney, Agent, or Firm*—Eyre, Mann, Lucas & Just

[57] ABSTRACT

For taking up less space when not in use, a ski is designed with a folded joint between its ends. For locking the front and back parts of the ski in the in-line condition ready for use, it is possible to have a top part acting as a splint which is bolted, for example, to the inner ends of the two ski parts, possibly between two heel-pieces on top of the ski parts. As a further possible design, the system for locking the ski parts in the in-line position, two links with a toggle function may be used or the top face of the two ski parts may have a female guide into which the top part is slipped. As a further possible locking system, the two ends of the ski parts nearest each other are designed with a hollow into which a locking core-piece with side headers acting as teeth is placed and which is kept in position by a metal cover plate on top of it. In a further design as part of the present invention, a toggle lever and a chain link are present on the top face of the ski at the position where its two halves are joined together. One end of the chain link furthest from the lever is slipped over a hook and then the lever is pushed downwards pulling tight the chain link and making certain of a stiff overall ski structure.

10 Claims, 11 Drawing Figures

1
1'
1"
2
3
3'
3'''
4
5
6
6'
7
1(2)

COLLAPSIBLE SKIS

The present invention is with respect to a collapsible or folding ski, for example a cross-country ski, a downhill ski or a slalom ski.

Because of their great length (up to 2,2 meters), skis have to be transported in baggage cars on using a railroad, on special purpose roof racks when the skier is using a car, or, in the case of busses, on specially made stands on the back bumper of the bus.

Anything transported on rood racks necessarily makes for an increase in the C-value of a vehicle so that a car driver is less well able to keep on a straight path when there are heavy side winds. Furthermore, there is a danger on transporting skis on roof racks inasfar as any ski falling from the rack may well get in the way of the next car on the road.

One purpose of the present invention is that of designing skis to take care of such shortcomings and troubles in connection with transport. For effecting this and other purposes the folding or collapsible ski of the present invention is characterized by a front part, having the ski toe, and a back part joined up by a join (such as a simple turning join, a double turning join or a join with male and female parts) with the front ski part to take the form of a ski base, and a ski top part joining all parts of the ski together as a stiff unit ba using fixing parts, the ski top part forming the elastic and stabilizing part of the ski while the ski base, made up of the ski front and back parts, gives the ski the necessary strength.

The ski of the present invention may be cut down to half its normal length for transport by separating completely or folding the two halves of the ski after undoing the fixing parts so that the ski may now be folded round the freely moving simple, double or other turning joint or connection with male and female parts and which is more specially in the middle of the ski.

The ski, that is to say in most cases, two skis designed on the lines of the present invention may be readily packed in the trunk of a car or placed on the car's back seat or furthermore transported in a taxi, on a mounting or other railroad, for example in the baggage net. On transport in a car, no special roof rack will be necessary. Furthermore, skis placed in the trunk of a car are much less likely to be taken by thieves than when they are on a roof rack.

If the user takes such skis with him on a walk in the mountains, the skis may readily be packed in a rucksack and they hardly get in the way of the owner. He is able to keep his hands free for climbing so that climbing itself becomes safer.

If the toe of the one ski is broken off or an other part gets out of order, the broken or damaged part may readily be exchanged for a new one and it is not necessary for the complete ski to be replaced. The ski top part may be designed as a very stiff or as a springing, elastic part specially meeting the needs of the owner.

An account will now be given of some working examples of the invention in detail.

Figures 1, 1A, 2, 3:
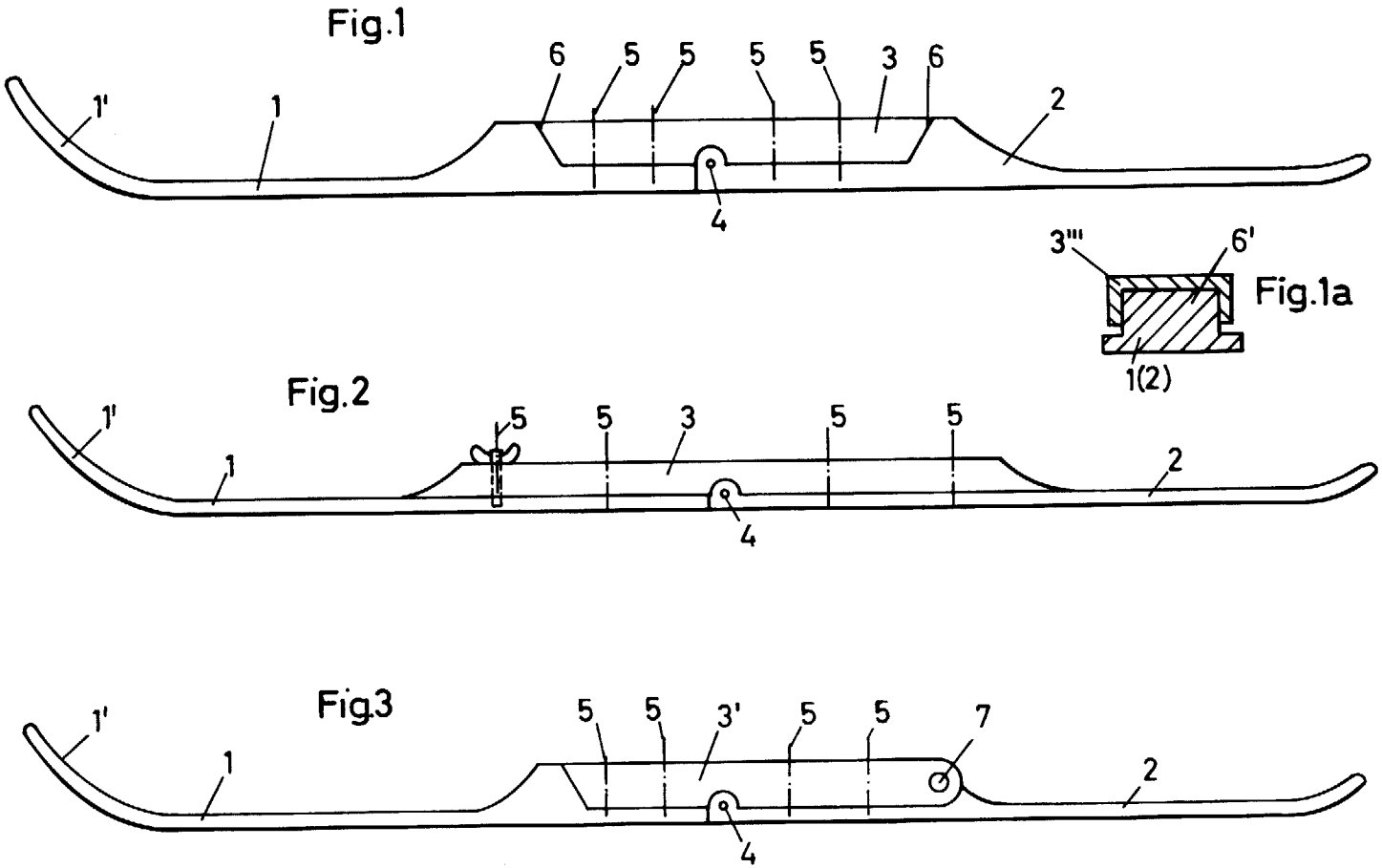
FIGS. 1 and 2 are side views of different working examples of the ski of the invention, whose top part may be taken off, with a cross-sextion in FIG. 1*a*.
FIG. 3 is a side view of one working example of the ski of the invention with the ski top part turningly joined or hinged to the back part.

The working examples of the ski of the invention to be seen in FIGS. 1 to 3 are, in each case, made up of a front part 1 with a ski toe 1' and a back part 2 which are joined together with the help of a turning join (or joint) 4 or hinge so that they may be turned in relation to each other. For locking the ski front part 1 and the ski back part 2 together by way of a stiff connection in the case of the working examples of FIGS. 1 and 2, use is made of a ski top part 3 which is placed on the top side of the front part 1 and of the back part 2 covering over turning join or pivot 4. Using fixing parts 5, which may be made up for example of threaded bolts fixed and let into the front part 1 and the back part 2, and wing nuts for use on the bolts, the front part 1, the ski top part 3 and the back part 2 may be stiffly and rigidly joined or splinted together so that the ski front and back parts 1 and 2 are in line. In the case of the working example of FIG. 1, the ski top part 3 is taken up in a hollow with its two ends resting against support faces 6 at the two ends of the hollow, this being responsible for a specially stiff connection-together between the front part 1 and the back part 2.

In the working example of FIG. 3, the ski top part 3' joining the front part 1 and the back part 2 together, is turningly joined or jointed to back part 2 by pivot pin or a turnpin 7.

Figure 4:
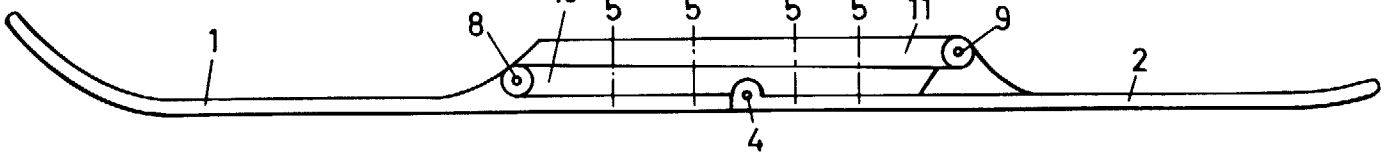
FIG. 4 is a side view of one working example of the ski of the invention in the case of which the ski top part is formed by two elements turningly joined to the front and, in the other case, to the back part of the ski.

A design on the same lines will be seen in FIG. 4, in which case the ski top part is, however, made up of two overlapping elements 10 and 11 turningly joined by turnpins 8 and 9 with the front part 1 and, in the other case, the back part 2 of the ski.

Figure 5:
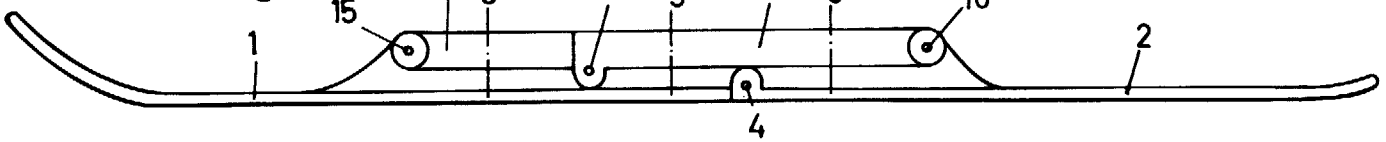
FIG. 5 is a side view of one working example of the ski of the invention in the case of which the ski top part is formed by two elements, which are turningly joined together and of which one is turningly joined to the front part and the other turningly joined to the back part of the ski.

In FIG. 5, the working example has a ski top part, made up of two elements 12 and 13, used for stiffly joining the front part and the back part of the ski, elements 12 and 13 being joined turningly together by a turnpin 14 while their other ends are hinged or joined using turnpins 15 and 16 with the front part 1 and the back part 2 of the ski.

Figure 6:
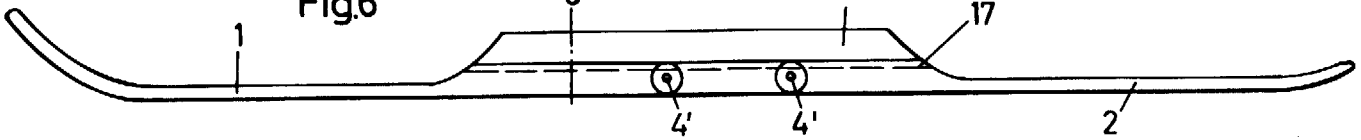
FIG. 6 is a view of a working example in the case of which the front and back parts are joined together by a join having two axes of turning.

In the working example of FIG. 6, the front part 1 and the back part 2, joined together by a double turning point 4'/4', may be locked or splinted in their stretched out or in-line condition by a ski top part 3'', which may be slipped into a female guide 17 (present in the front part 1 and in the back part 2) in the lengthways direction, female guide 17 lockingly positioning the ski top part 3'' not only in a direction normal to the top side and lower side of the ski, but furthermore in the sideways direction with respect to the ski, that is to say the ski top part 3" may only be moved (in relation to the rest of the ski) in the lengthway direction. For this reason, in the case of the working example of FIG. 6, a single fixing part 5 is all that is necessary for fixing and locking the ski top part 3" in position. It will be clear that in place of threaded bolts and wing nuts, other fixing parts 5 may be used if desired.

Figure 7:
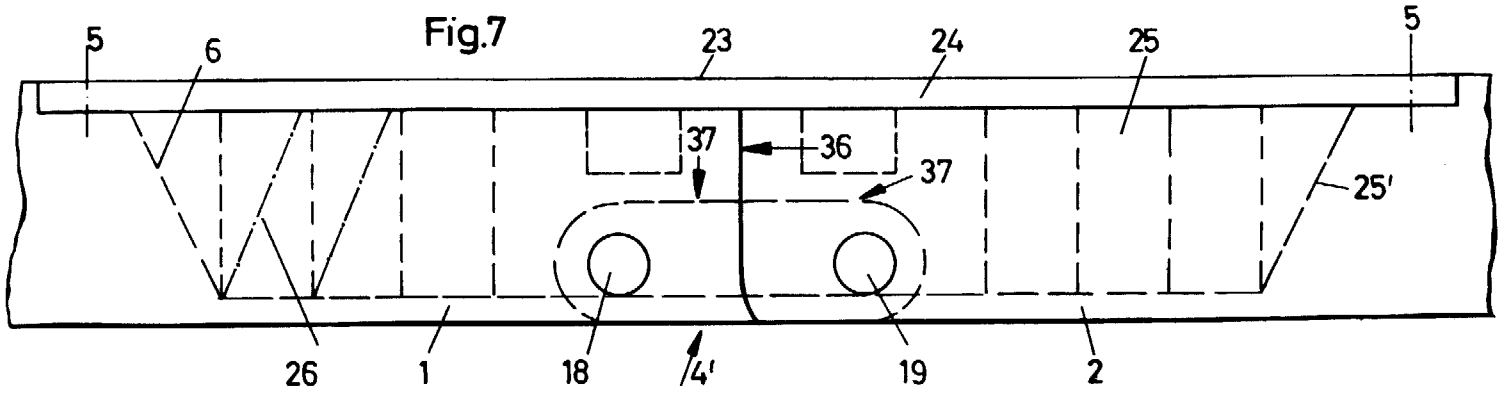
FIG. 7 is a view on a greater scale of part of the front and back parts of a ski of the present invention using a double axis connection or join.

FIG. 7 is a view of a form of the invention in which the front part 1 and the back part 2 are joined together by a double turning join or hinge 4' having two turnpins 18 and 19 in at least two links 20 and 21. The links 20 and 21 are bearinged, in each case, on turnpin 18 turningly fixed to the front ski part 1 and, the other end of the links, on turnpin 19 turningly fixed to the back ski part 2, the links being nested in hollows stretching upwards from the running face of the ski, that is to say the lower faces of the front part 1 and the back part 2. For producing a simple bearing system for turnpins 18 and 19, it may be best for the two side faces of the front part 1 and of the back part 2 to be fixed, in each case, to a metal plate 22 to give a bearing at each end of each turnpin 18 and 19 in such metal plate 22. For stiffly fixing together the front part 1 and the back part 2 and locking them in the stretched out condition with a splinting effect in the working example of FIGS. 7 and 8, use is made of a ski top part 23 made up of a plate-like part 24 and of a rail-like part 25 running out from the lower side of this plate-like part. The rail-like part 25, which has sloping faces at its ends 25', is shorter than the plate-like part so that plate-like part's two ends will be seen to be running out past the rail-like part. The rail-like part 25, which on its sides stretching in the length-direction has teeth 26 or headers, is taken up in a female hollow 27 having the same form as it, such hollow being partly within the front part 1 and partly within the back part 2 of the ski. When it has been put in place, the plate-like part 24 will have its lower face, which is longer than the rail-like part 25, resting on the top side of the front and back parts of the ski. By using the fixing parts 5 the ski top part 23 can be fixed in position as long as desired on the front part 1 and on the back part 2. The headers 26, taken up in pockets 28 in hollow 27, are responsible for a specially stiff connection of all parts together because of the locking effect. The front part 1 and the back part 2 will be touching at their end faces 36 when the top part has been put in position. Furthermore, the links 20, 21 will be resting at 37 against the front part 1 and the back part 2.

Figure 8:
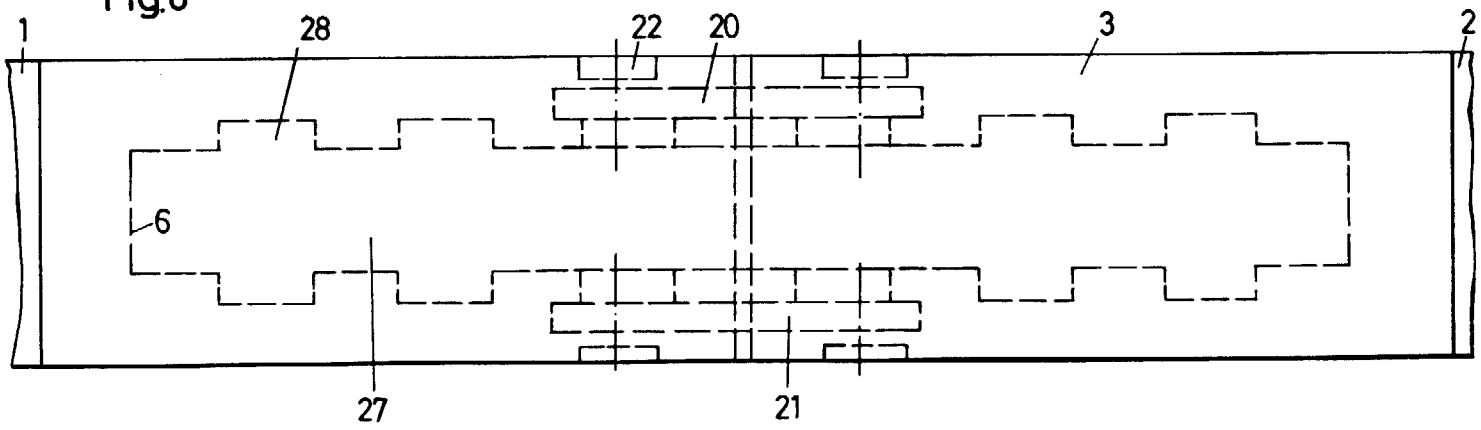
FIG. 8 is a plan view of the working example of the invention of FIG. 7.
Figure 9:
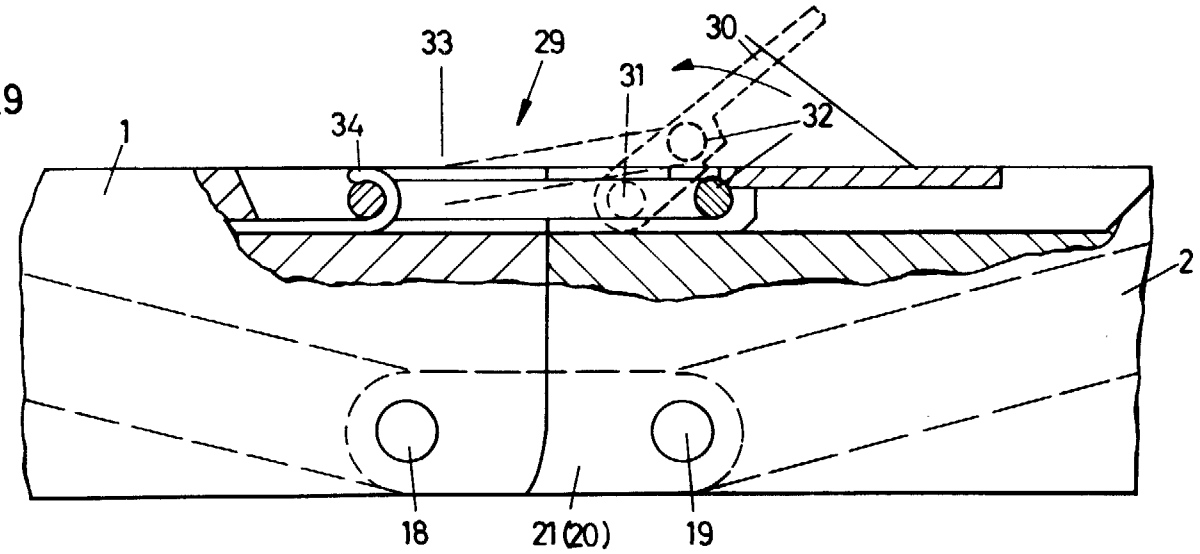
FIG. 9 is a view on the same lines as FIG. 7 with some changes in the design.

The working example of FIG. 9 is different to that of FIGS. 7 and 8 mainly because, in place of the ski top part 23, use is made of a high-speed fastener 29 for joining the front part 1 and the back part 2. The fastener itself may be conventional in design.

The fastener is made up of a lever 30, bearinged at one end on turnpin 31 at the top side of back part 2. Between the free end of the lever 30 and turnpin 31, the right hand end of a chain link 33 is turningly joined at 32 with lever 30. When the lever 30 is turned or folded upwards, the left hand end of chain link may be joined up with a hook 34 on the front ski part 1. By folding down lever 30 about turnpin 31, that is to say in the clockwise direction in the case of FIG. 9, the front part 1 and the back part 2 are pulled tightly together and a stiff connection formed.

Figure 10:
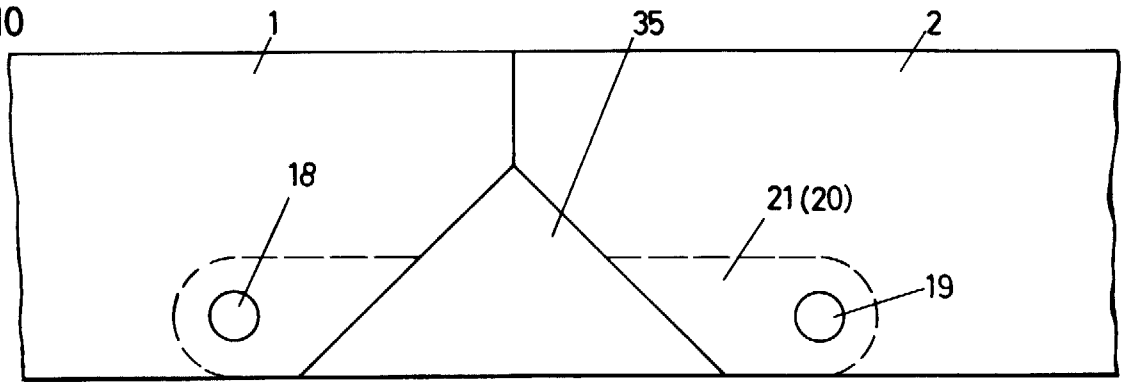
FIG. 10 is a side view of a further possible working example of the double join connection.

FIG. 10 is a view of a further working example in which the ski parts 1 and 2 (joined together by a join 4' with two turnpins) may be fixed stiffly in relation to each other in the stretched out condition by a three-sided element 35, which may be put in place upwards between sheet parts 1 and 2 into a female hollow in which it may be fixed.

As will be seen from FIG. 1*a*, the front part 1 and the back part 2 may be designed with an upwardly stretching part or core 6' near the join, for example the turning join 4, which is then taken up within a female shell top part 3''' of U-like cross-section.

It is furthermore possible, for example in the forms of the invention in FIGS. 7 and 8, for the ski to be designed without the plate-like part 24 so that the top part 23 is only made up of the rail-like element 25. In place of this design measure, or in addition thereto, the top part 23 may be fixedly joined with one end of the top part 1 or the back part 2 so that the free end of the top part is then guided into the hollow 27 when the two parts of the ski (1 and 2) are folded outwards into the straight condition. The pockets 28, as marked in broken lines in FIG. 7, in the case of this last form of the invention, are curved.

I claim:

1. A collapsible ski having a front ski part having a ski toe and a back ski part, a join for joining said front ski part and said back ski part together for forming a ski base-part, a ski top part, said ski top part being formed by two elements one of which is pivotally joined to the ski front part and the other of which is pivotally joined to the ski back part, said ski top part being placeable at least in part in a recess in the ski base-part and lockable in position on said ski base-part by fixing means.

2. A ski as claimed in claim 1, wherein said two elements are of such a length as to be overlapped when said ski is unfolded and in its straight condition ready for use.

3. A ski as claimed in claim 1, wherein said two elements pivotally joined with the ski front and ski back parts are also pivotally joined together.

4. A ski as claimed in claim 3, wherein the pivot join pivotally joining the two elements forming the ski top part is out of line with the join between the ski front and the ski back parts when the front and back parts of the ski are in line with each other in the ready-for-use conditions.

5. A collapsible ski having a front ski part with a ski toe and a back ski part, said ski parts being pivotally joined together by a double-turning join, said join comprising at least two join links each of which is pivotally connected to the front ski part by a first pin and to the back ski part by a second pin, further having a top ski part or connecting element which overlaps the front ski part and the back ski part and locks said ski parts together as a stiff ski structure in unfolded condition, wherein said join links are positioned in hollows stretching along the running faces of said ski parts, with the front ski part and the back ski part touching at their end faces and with the join links abutting against the front ski part and the back ski part in unfolded condition, and wherein said top ski part is a rail-like part taken up in an accommodating female hollow, said hollow being formed partially in the front ski part and partially in the back ski part.

6. A collapsible ski as claimed in claim 5, wherein said rail-like part has projections on its longitudinal sides, which projections engage pockets in the hollow in unfolded ski condition.

7. A collapsible ski having a front ski part with a ski toe and a back ski part, said ski parts being pivotally joined together by a double-turning join, said join comprising at least two join links each of which is pivotally connected to the front ski part by a first pin and to the back ski part by a second pin, further having a top ski part or connecting element, which overlaps the front ski part and the back ski part and locks said ski parts together as a stiff ski structure in unfolded ski condition, wherein said join links are positioned in hollows stretching along the running faces of said ski parts, with the front ski part and the back ski part touching at their end faces and with the join links abutting against the front ski part and the back ski part in unfolded ski condition, and wherein said top ski part is formed by two elements one of which is pivotally joined with the front ski part and the other of which is pivotally joined with the back ski part.

8. A ski as claimed in claim 7, wherein said two elements are of such a length as to be overlapped when said ski is in the unfolded ski condition.

9. A ski as claimed in claim 7, wherein said two elements pivotally joined with the front ski part and the back ski part are also pivotally joined together by pivot join.

10. A ski as claimed in claim 9, wherein the pivot join pivotally joining said two elements forming the ski top part is out of line with the join between the front ski part and the back ski part when the front ski part and the back ski part are in line with each other in the unfolded ski condition.

* * * * *